US007407631B2

(12) United States Patent
Swon et al.

(10) Patent No.: US 7,407,631 B2
(45) Date of Patent: Aug. 5, 2008

(54) APPARATUS AND METHOD FOR AGITATING A SAMPLE DURING IN VITRO TESTING

(75) Inventors: James E. Swon, Chapel Hill, NC (US); C. J. Anthony Fernando, Durham, NC (US)

(73) Assignee: Varian, Inc., Palo Alto, CA (US)

( * ) Notice: Subject to any disclaimer, the term of this patent is extended or adjusted under 35 U.S.C. 154(b) by 444 days.

(21) Appl. No.: 10/829,640

(22) Filed: Apr. 22, 2004

(65) Prior Publication Data

US 2005/0238540 A1 Oct. 27, 2005

(51) Int. Cl.
*B01L 9/00* (2006.01)

(52) U.S. Cl. ..... 422/104; 422/102; 422/135; 366/273; 366/274

(58) Field of Classification Search ..... 422/99, 422/100, 101, 102, 129, 130, 131, 104, 135; 436/174, 179, 180; 366/241, 242, 244, 273, 366/274, 279

See application file for complete search history.

(56) References Cited

U.S. PATENT DOCUMENTS 3,801,280 A 4/1974 Shah et al.
4,759,635 A * 7/1988 MacMichael et al. ..... 366/274
5,011,662 A 4/1991 Noormohammadi et al.
5,215,717 A * 6/1993 Conant et al. ..... 422/102
5,267,791 A * 12/1993 Christian et al. ..... 366/249
5,412,979 A 5/1995 Fassihi
5,540,496 A 7/1996 Beckett et al.
6,126,904 A * 10/2000 Zuellig et al. ..... 422/130
6,582,116 B2 * 6/2003 Nielsen ..... 366/279
6,692,708 B2 * 2/2004 Chandler, Jr. ..... 422/225
7,074,364 B2 * 7/2006 Jahn et al. ..... 422/62

OTHER PUBLICATIONS

United States Pharmacopoeia, vol. 24, Ch. 711, pp. 1941-1944 & Ch. 724, pp. 1941-1951 (1998).

* cited by examiner

*Primary Examiner*—Jill Warden
*Assistant Examiner*—Dwayne K Handy
(74) *Attorney, Agent, or Firm*—Bella Fishman; David P. Gloekler

(57) ABSTRACT

In an apparatus and method for agitating a sample during dissolution or other in vitro testing, a movable component is disposed in a container for reciprocating or rotating a sample carrier such as a dosage form or stent through a medium in the container. The apparatus can include a closure member to seal the container for substantially preventing loss of contents during movement of the sample carrier. The movable component can be actuated by a driving source in a non-contacting manner. The movable component can include a magnet drivable by a source external to the container. The container can include first and second container sections having different volumes, in which case actuation of the movable component causes agitation of the sample carrier through a medium contained in one of the container sections. The container can include a hole at or near the bottom for filling the container, using instruments, and the like.

17 Claims, 7 Drawing Sheets

APPARATUS AND METHOD FOR AGITATING A SAMPLE DURING IN VITRO TESTING

FIELD OF THE DISCLOSURE

The present invention relates generally to in vitro testing of medical components, including implantable, ingestible or adherable medical components, such as dosage forms, stents, and other carriers of materials having immediate and/or controlled release characteristics, and testing of implantable medical devices such as stents, prostheses, sensors, catheters, electrical leads, and the like. More particularly, the present invention relates to apparatus and methods for providing actuated movement of such medical components during testing, the prevention of evaporation loss during movement, and components adapted for such apparatus and methods.

BACKGROUND OF THE DISCLOSURE

In vitro testing methods such as dissolution testing are useful for simulating the conditions under which a substance such as a pharmaceutical formulation is released under controlled conditions into a physiological environment such as a gastrointestinal or vascular environment. The releasing of a sample formulation into appropriate media such as by dissolution facilitates the acquisition of optical signals or other data from which concentration, release rate or other information can be derived for prediction of or correlation with actual, in vivo conditions. Some techniques entail agitation of the sample in media such as by stirring, rotation, or reciprocation.

For example, Chapters 711 (Dissolution) and 724 (Extended Release) of the United States Pharmacopoeia (USP) guidelines describe the use of several techniques for performing agitation in test vessels containing a dissolution medium that is usually temperature-regulated. These techniques include the use of a rotating basket (Apparatus 1), a rotating paddle (Apparatus 2), a reciprocating cylinder (Apparatus 3), and a reciprocating holder (Apparatus 7). Each apparatus requires the insertion of a motor-powered shaft into the test vessel. In Apparatus 1, a stainless steel basket with mesh sides is provided to contain a tablet, capsule or other dosage form and is rotated by a stainless steel shaft. In Apparatus 2, a rotating paddle is formed from a blade and shaft. In Apparatus 3, a glass reciprocating cylinder with open, mesh-covered ends is provided to contain a dosage form. The reciprocating cylinder is vertically raised and lowered in a vessel at a prescribed dip rate. The top of the reciprocating cylinder has a perforated cover that is attached to a shaft. An evaporation cap is fitted over the reciprocating cylinder and the container. This cap, however, has air holes and the shaft required for reciprocation extends through the cap. Hence, the cap cannot fully seal the interior of the container, and an unacceptable loss of solution by evaporation can result. A similar apparatus is described in U.S. Pat. No. 5,011,662. Similarly, in Apparatus 7, other types of sample holders attached to shafts, such as nylon net bags, CUPROPHAN® material, stainless steel coils, TEFLON® disks, and TEFLON® cylinders, are vertically reciprocated in vessels for the testing of dosage forms such as tablets and transdermal patches.

As noted, all such systems have historically required the use of a shaft that must be extended into the media container in order to be able to reciprocate, rotate or stir the sample through the media and thereafter removed. Accordingly, a significant amount of evaporation loss often cannot be avoided in these systems. Evaporation loss can reduce the effectiveness of testing procedures entailing agitation. Moreover, shafts are prone to wobble or become misaligned and hence frequently require recalibration or replacement. In addition, the containers employed to hold media have traditionally been sized to accommodate the largest type of sample or sample holder to be tested. In this manner, the same-sized container can be employed in the testing of a wide range of differently sized samples and sample holders. However, when testing relatively small samples, the standardized container size provides an excessively large volume of media through which the sample is reciprocated. As a result, the resolution of data acquired during testing is not optimized for many kinds of samples. Furthermore, conventional testing methods and apparatus are not specifically designed for handling, supporting, and testing newer types of pharmaceutical delivery means such as stents and other carriers of analytical material.

Therefore, a need exists for an apparatus and method for agitating a sample in a container while preventing—i.e., substantially reducing or eliminating—the loss of contents of the container via evaporation or other mechanisms. A need also exists for an apparatus and method for agitating a sample in a container without the requirement of a shaft extending into the container from the ambient environment. A need further exists for an apparatus and method for agitating a sample in a container in which the volume of the container is better tailored to the size of the sample, the sample holder, and/or other items residing in the container. A need further exists for an apparatus and method for handling, supporting, and testing certain types of carriers of drug compounds or other analytical materials.

SUMMARY OF THE DISCLOSURE

According to one embodiment, a device for actuating movement of a sample carrier during in vitro testing comprises a movable component for supporting the sample carrier in a container. The movable component comprises a drivable component actuatable by non-contacting coupling with a driving source.

According to another embodiment, an apparatus for actuating movement of a sample carrier during in vitro testing comprises a container and a movable component. The movable component is disposed in the container for supporting a sample carrier therein and is drivable by non-contacting coupling with a driving source.

According to another embodiment, an apparatus for actuating movement of a sample carrier during in vitro testing comprises a container, a movable component disposed in the container for supporting a sample carrier therein, and a closure member. The closure member seals the container for substantially preventing loss of contents from the container during actuation of the movable component by a driving source.

According to another embodiment, a container is provided for containing an actuatable sample carrier during in vitro testing. The container comprises first and second container sections. The first container section has a first section volume for containing a drivable component drivable by a driving source. The second container section has a second section volume different from the first container volume for containing a sample carrier connected to the drivable component.

According to another embodiment, a closure device is provided for sealing a container. The closure device comprises a body for covering an opening of the container, and a magnet attached to the body for coupling with a sample carrier holder.

According to another embodiment, a support device is provided for supporting a sample carrier. The support device comprises a body, first and second support members, and a coupling member. The first and second support members are attached to the body and are axially spaced for securing a sample carrier between the first and second support members. The coupling member is attached to the body for coupling with a driving source.

According to a method for agitating a sample carrier, a movable component is provided in a container. The movable component supports a sample carrier carrying material releasable into a medium. The movable component is actuated to move in the container by coupling the movable component with a driving source disposed in non-contacting relation to the movable component.

According to another method for agitating a sample carrier, a movable component that supports a sample carrier is provided in a container comprising first and second container sections having different volumes. The movable component is actuated to move in the container to allow a material provided by the sample carrier to be released into a medium in one of the container sections.

According to a method for manipulating a sample carrier containing releasable material, a closure member is provided and is adapted for sealing an open end of a container. The closure member is coupled with a support device supporting the sample carrier. The coupling between the closure member and the support device enables the sample carrier to be manipulated by handling the closure member without manually contacting the sample carrier.

A method is also provided for securing a sample carrier containing releasable material to a sample carrier holder in preparation for agitating the sample carrier in a container. The sample carrier is mounted to the sample carrier holder such that a first portion of the sample carrier contacts a first support member of the sample carrier holder. A second support member is attached to the sample carrier holder such that the second support member contacts a second portion of the sample carrier.

In some embodiments or methods, non-contacting coupling is accomplished by magnetic coupling. In some embodiments or methods, permanent magnets are employed for this purpose.

In other embodiments or methods, one or more electromagnets are employed to enable selective energization and de-energization and therefore selective coupling and decoupling.

In some embodiments or methods, actuation of the movable component is by reciprocation. In other embodiments or methods, actuation is by rotation or spinning.

In some embodiments or methods, a pick-up component disposed in the container can be coupled with the movable component to facilitate handling of the sample carrier. In some embodiments or methods, the pick-up component includes a magnet for magnetic coupling. In some embodiments or methods, the pick-up component is mounted to, attached to, or otherwise integrated with a closure member.

In some embodiments or methods in which a container is provided, the container has an opening at its bottom to provide access into the container for purposes such as conducting fluid to and from the container or using probes or other instruments. A sealing or closure member can be employed to selectively close the bottom opening. The sealing or closure member can be provided as a fitting for a conduit such as tubing.

According to any of the foregoing embodiments or methods, the sample carrier may contain a material releasable in a medium. The sample carrier may include an implantable, adherable or ingestible medical component. For example, the sample carrier may include a dosage delivery component such as a dosage form, a stent or other dosage delivery component for purposes of testing, ingestion, transdermal transfer, or implantation. The sample carrier may also be a component that supports (e.g., holds, contains, affixes, etc.) a dosage delivery component. The sample carrier may also be a medical device such as may be implanted or inserted in, or applied to, a living being, or a component that supports (e.g., holds, contains, affixes, etc.) a medical device of this type.

Other embodiments and methods comprise one or more of the features or elements recited above.

DETAILED DESCRIPTION OF THE DISCLOSURE

Figure 1:
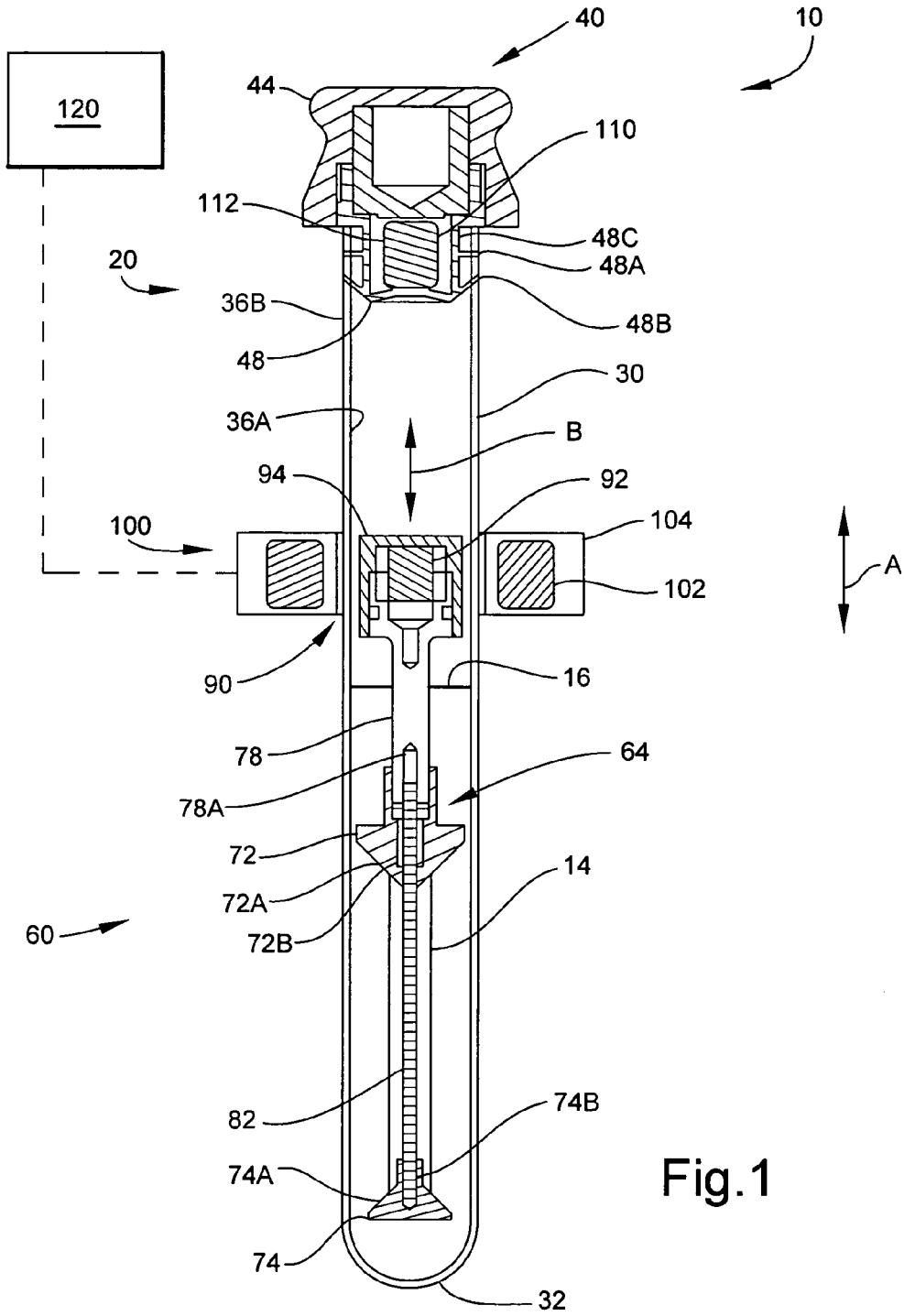
FIG. 1 is a cross-sectional elevation view of a sample test apparatus comprising a test vessel unit and an external driving component according to an embodiment disclosed herein.

In general, terms such as "communicate", "coupled" and the like (e.g., a first component "communicates with" or "is in communication with" a second component) are used herein to indicate a structural, functional, mechanical, electrical, optical, magnetic, or fluidic relationship between two or more components or elements. As such, the fact that one component is said to communicate or be coupled with or a second component is not intended to exclude the possibility that additional components may be present between, and/or operatively associated or engaged with, the first and second components.

As used herein, the term "dosage form" generally encompasses any composition or structure that includes a releasable quantity of material that can provide a sample in dissolution testing or other types of testing. The releasable quantity of material can be, for example, a therapeutically active agent such as pharmaceutical drug, chemical, biochemical, or biologically active material intended for in vivo delivery by ingestion, injection, insertion, transdermal delivery, surgical implantation, or the like in a human or animal. The releasable material may be soluble, elutible, suspendable, or diffusible in a suitable medium, or mixable with a medium, or otherwise combinable with or transportable to a medium to facilitate analysis of one or more components of the releasable material by any desired means. Non-limiting examples of dosage forms include tablets, capsules, caplets, gel caps, pellets, microspheres, suppositories, pessaries, gels, ointments, oils, creams, and transdermal patches. In addition, a dosage form can include one or more non-active materials used as fillers, excipients, carriers or retainers of the active agent, coloring agents, tagging or marking agents, preservatives, buffers, means for controlling the release rate of the active material, or a combination of two of more of these functions, and/or for other purposes. Generally, a wide variety of dosage forms are available and known to persons skilled in the art.

As used herein, the term "sample carrier" generally encompasses any dosage form or other structure or material capable of carrying a releasable quantity of material. A "sample carrier" can include any dosage delivery mechanism. In addition to dosage forms, another example of a "sample carrier" is a stent or similar type of prosthesis. Some types of stents can function as a drug delivery mechanism in addition to the more conventional function of keeping a blood vessel open. Typically, a stent can include a generally cylindrical or tubular structure that can be surgically implanted in a blood vessel or other lumen, such as by employing a vascular catheter. A common type of stent is constructed by weaving several filaments in helical patterns to form a tubular, braided structure that is deformable and often has shape memory to some degree. The filaments may be metallic or polymeric. Depending on the function of the stent, the filaments may be essentially permanent or degradable over time subsequent to implantation. The stent may be self-expanding or require the use of a balloon for expansion. The stent can be of the type that is coated with or otherwise carries a releasable material that can be released from the stent at a controlled rate via elution, diffusion, or other mechanism of transport. Generally, a wide variety of stents are available and known to persons skilled in the art.

In addition to dosage forms and stents, other non-limiting examples of "sample carriers" include implantable (bio)(chemo)sensors such as glucose sensors, infusion catheters, dental implants, neurostimulation leads, and spinal repair devices, as these terms are understood by persons skilled in the art.

As used herein, the term "medium" or "media" generally encompasses a solvent such as water, alcohol, and/or any other medium into which a releasable material can be released, as well as any additives or reagents. Often, the medium is buffered at a desired pH level or formulated to emulate a physiological environment such as a gastrointestinal environment or a luminal or coronary environment such as a blood vessel. The term "medium" or "media" can also include materials released from a dosage form, stent or the like, for example a therapeutically active agent, excipient, release rate modifier, and the like. Thus, the term "medium" or "media" can encompass a multi-component combination or matrix such as can be produced in a test vessel, including a solution, suspension, emulsion, particulate-laden mixture, colloidal mixture, or the like.

Examples of embodiments of the subject matter disclosed herein will now be described in more detail with reference to FIGS. 1-7.

FIG. 1 illustrates a sample testing apparatus according to one embodiment, generally designated 10. Sample testing apparatus 10 can be employed to cause, facilitate, or provide an environment for the release of releasable materials such as therapeutically active agents or other sample analytes of interest from one or more sample carriers 14 into a suitable medium 16. Sample testing apparatus 10 can be utilized in preparation for or in conjunction with measuring a property or quality relating to the performance of sample carrier 14 or of the releasable material, such as the rate at which an analyte is released from sample carrier 14 over a designated time period. Sample testing apparatus 10 can comprise one or more test vessel units, generally designated 20; and one or more non-contact driving sources or components, generally designated 100. Test vessel unit 20 can comprise a container or test vessel 30; a closure member or device, generally designated 40; and a non-contact movable component or device, generally designated 60, which is drivable by non-contact driving component 100. The term "non-contact" or "non-contacting" means that driving component 100 interacts with movable component 60 in a manner that does not require physical contact between these components, as described by way of example more fully below.

Figure 2:
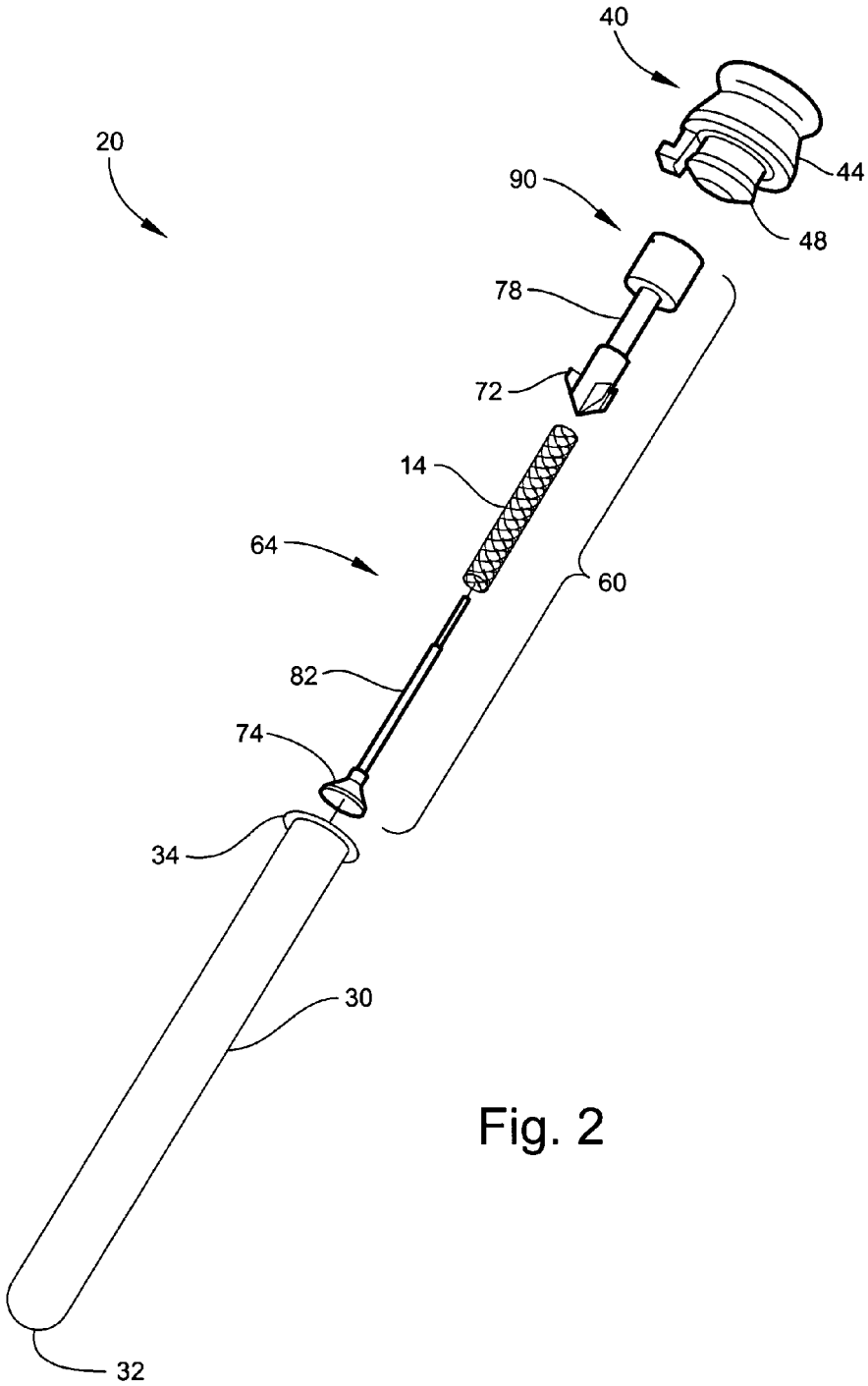
FIG. 2 is an exploded view of the test vessel unit illustrated in FIG. 1A.
Figure 6:
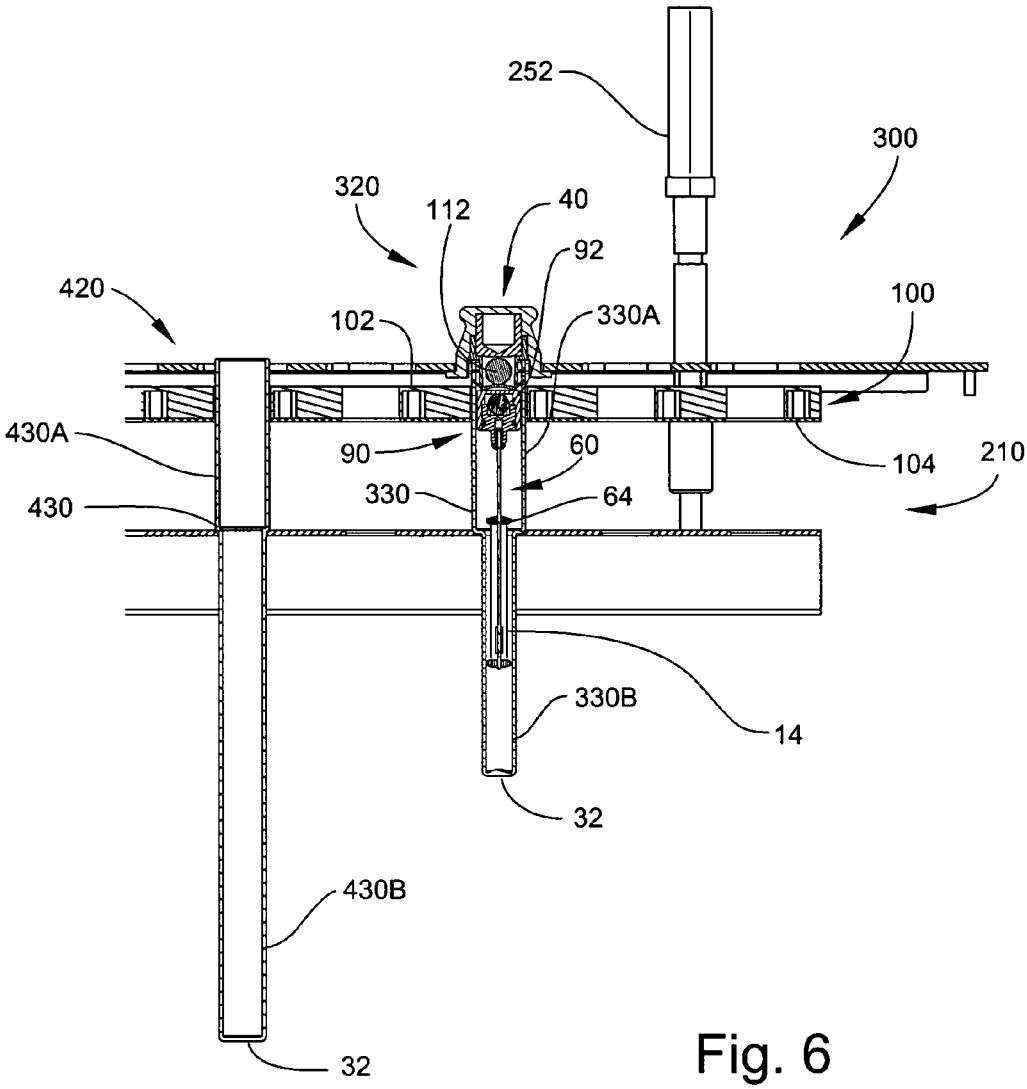
FIG. 6 is a cross-sectional elevation view of a portion of a sample test apparatus according to an embodiment in which one or more test vessel units have stepped profiles.

Container 30 can comprise, for example, a tube or vial that typically includes a closed bottom 32 and an opening 34 at its top (FIG. 2). Bottom 32 can be hemispherical or rounded as shown in FIG. 1, or generally flat as shown in FIG. 6. Generally, container 30 can be any structure useful for containing one or more sample carriers 14 and a medium 16 into which one or more materials provided by sample carrier 14 can be released. Preferably, container 30 is constructed from an inert material, i.e., a material that does not sorb, react or interfere with the analyte being tested. Typically, container 30 is constructed from glass or other material that is transparent or translucent to enable visual access into the interior of container 30. In addition, the material of container 30 is preferably capable of transferring heat in a case where temperature regulation of media 16 in container 30 is desired. In addition, the glass or other material is preferably one that can be manufactured to industry-accepted, repeatable tolerances.

Closure member 40 can comprise any structure that functions to seal opening 34 (FIG. 2) and thereby completely or at least substantially prevent the loss of media 16 or other contents from container 30 during the course of a testing procedure. In particular, closure member 40 prevents or at least significantly reduces the escape of evaporated media 16 from container 30, especially under pressurized conditions such as can occur when the contents of container 30 are being heated. In advantageous embodiments, closure member 40, or at least those portions of closure member 40 in contact with container 30, is constructed from a resilient material such as rubber, polyethylene, or other suitable polymer, or a metallic material, to provide an effective seal. Generally, closure member 40 can be a stopper, septum, plug, cap, or any other structure sufficient to cover opening 34 (FIG. 2) of container 30 and thereby isolate the interior of container 30 from the ambient environment. In the illustrated embodiment, closure member 40 includes a main portion or body 44 and a central portion or body 48 extending from the main body 44. Main body 44 covers opening 34 and the contact between main body 44 and container 30 may contribute to the sealing of container 30. Main body 44 can be constructed from a rigid material such as DELRIN® or a resilient material.

In the exemplary embodiment illustrated in FIG. 1, central portion 48 of closure member 40 extends into container 30. One or more surfaces of central portion 48 contact container 30 to form the seal, and thus one or more portions of central portion 48 are advantageously constructed from a resilient material such as polyethylene. In some embodiments, central portion 48 includes one or more annular ribs 48A and 48B that serve as the surfaces sealingly contacting the inside of container 30. The diameter of each rib 48A and 48B can be sized larger than the diameter of an inside surface 36A of container 30 to create an effective sealing interface with container 30 upon insertion of central portion 48 therein. In other embodiments, an outer lateral surface 48C of central portion 48 can be sized to tightly abut against inside surface 36A of container 30 to effect the seal. In still other embodiments, main body 44 or central portion 48 can include an extended portion (not shown) configured to sealingly fit against an outer surface 36B of container 30 in a similar manner.

Movable component 60 can be disposed in the interior of container 30 as illustrated in FIG. 1. Movable component 60 can comprise any structure or device suitable for supporting, holding, or retaining one or more sample carriers 14, and which is capable of being driven to reciprocate, rotate or otherwise move within container 30 without breaking the sealed state of container 30. For example, movable component 60 can be configured to be actuatable by a driving component 100 that is disposed in non-contacting relation to movable component 60. For these purposes, movable component 60 can comprise a sample carrier holder or support member, generally designated 64; and a drivable component, generally designated 90, attached to or integrated with sample carrier support member 64. In some embodiments, movable component 60 can generally be considered as including a body or structure, which advantageously is elongated in the axial direction. The body or structure of movable component 60 can include one or more portions or sections. Sample carrier support member 64 and drivable component 90 are attached to or, equivalently, integrated with or form a part of, the body or structure of movable component 60 or one or more of its constituent portions or sections. In some embodiments as illustrated in FIG. 1, the body or structure of movable component 60 can include a portion or section 78 and a portion or section 82.

As indicated previously, sample carrier 14 can comprise any dosage delivery mechanism—that is, any dosage form or other structure or material capable of carrying a releasable quantity of material such as a drug formulation that can be released from sample carrier 14 when subjected to a solvent or other suitable medium 16. Likewise, the structure of sample carrier support member 64 may depend on the type of sample carrier 14 utilized in sample testing apparatus 10. By way of example only and not as a limitation on the scope of the subject matter disclosed herein, FIGS. 1 and 2 illustrate a sample carrier 14 provided in the form of a stent. Accordingly, sample carrier support member 64 in this example is structured to serve as a stent holder. In other embodiments, sample carrier support member 64 can comprise a basket, disk, netting, cell, cylinder, or the like as needed for supporting or containing other types of sample carriers 14 (e.g., tablets, transdermal patches, etc.) during reciprocation through media 16.

To secure sample carrier 14 to sample carrier support member 64 in a stable manner, sample carrier support member 64 in the present embodiment includes a first support member 72 and a second support member 74 between which sample carrier 14 is mounted. First and second support members 72 and 74 include respective first and second inward-facing surfaces 72A and 74A—i.e., surfaces that face each other and sample carrier 14—against which opposite ends of sample carrier 14 respectively contact or abut. In some embodiments, first and second inward-facing surfaces 72A and 74A are each generally cone-shaped or otherwise angled or tapered relative to the longitudinal axis of container 30 to accommodate sample carriers 14 of different diameters. In some embodiments, first support member 72 is attached to a structure of movable component 60 such as portion 78 that can serve as an axial extension or spacer member between sample carrier support member 64 and drivable component 90.

First and second support members 72 and 74 can be kept spaced apart from and aligned with each other by providing a support rod or portion 82 interconnected between them. First and second support members 72 and 74 can include respective bores 72B and 74B into which the opposing ends of support rod 82 extend. As can be seen in FIG. 2, support rod 82 can be made removably attachable to first support member 72, or to another component of sample carrier support member 64 such as spacer member 78, to facilitate the mounting of sample carrier 14 to sample carrier support member 64 and the subsequent removal therefrom. As shown in FIG. 1, the removable attachment can be accomplished by any means, such as by providing external threads on support rod 82 for engaging with internal threads formed in a bore 78A of spacer member 78 or bore 72B of first support member 72 that is axially aligned with bore 78A of spacer member 78. Sample carrier 14 is secured to sample carrier support member 64 by placing sample carrier 14 around the length of support rod 82, and inserting the free end of support rod 82 into bore 72B of first support member 72, or through bore 72B and into bore 78A of spacer member 78. Depending on which bores 78A or 72B are threaded, the securing of sample carrier 14 is completed by screwing or inserting the free end of support rod 82 into bore 78A or 72B. The free end of support rod 82 is screwed or inserted far enough into bore 78A and/or 72B to ensure that sample carrier 14 snugly abuts both first and second support members 72 and 74.

Alternatively, support rod 82 can be removably attached to second support member 74 in a similar manner, in which case second support member 74 can be removed from support rod 82 during loading or removal of sample carrier 14. The removability of first support member 72 and/or second support member 74 from support rod 82 also facilitates cleaning or replacement of these individual components.

It will be understood that the subject matter of the present disclosure is not limited to the use of threaded features as the fastening and adjustment means. As an alternative, for example, support rod 82 can be secured to first support member 72 and/or spacer member 78 by press-fitting.

As an advantage provided by any of these alternatives, support rod 82 is movable through bore 72B of first support member 72 and bore 78A of spacer member 78. Hence, the position of first support member 72 and/or second support member 74 is adjustable relative to the length of support rod 82 and thus relative to each other. This adjustability or variability in spacing enables sample carrier support member 64 to accept stents or other types of sample carriers 14 of different dimensions. In addition, it can be seen from FIG. 1 that sample carrier support member 64 secures sample carrier 14 with minimum contact, and maintains sample carrier 14 centered or substantially centered about the central longitudinal axis of container 30. This configuration avoids rubbing or impact between sample carrier 14 and sample carrier support member 64, and between sample carrier 14 and container 30, thereby enhancing the accuracy of in vitro dissolution testing.

It can be appreciated that the utility and advantages provided by sample carrier support member 64 can extend to a wide variety of sample carriers 14 and lab procedures. Accordingly, sample carrier support member 64 can be employed not only in conjunction with actuation in a non-contact manner such as described herein, but also in conjunction with actuation entailing a direct mechanical linkage with a driving source. Thus, the present disclosure encompasses embodiments and methods in which sample carrier support member 64 is employed with or without non-contact actuation. For example, sample carrier support member 64 can be adapted for direct mechanical reference to a shaft that communicates with a motorized drive assembly, such as when the use of a fully sealing closure member 40 is not desired or required.

Drivable component 90 can be any structure capable of being driven to reciprocate and/or rotate within container 30 without physically contacting or engaging the driving source so as not to defeat the sealed state of container 30. One advantage of providing a non-contact drivable component 90 is that the driving source can operate externally relative to container 30. In this manner, the ability of test vessel unit 20 to prevent evaporation or other material loss is fully coextensive with its ability to actuate movement or agitation by reciprocation, rotation, etc. In the illustrated embodiment, non-contact actuation is realized by providing a drivable component 90 that comprises an internal magnetic coupling component. The internal magnetic coupling component includes an internal magnet 92. Internal magnet 92 can be secured to or integrated with movable component 60 by any means that enables sample carrier support member 64 to be reciprocated or rotated with internal magnet 92 in response to a non-contacting driving input such as the operation of driving component 100. In the embodiment illustrated in FIG. 1, for example, drivable component 90 comprises a cap or housing 94 attached to spacer member 78 to enclose internal magnet 92.

Driving component 100 can be any structure capable of causing agitation in container 30 without needing to physically contact or engage any part of movable component 60, and consequently without impairing the sealed state of container 30 and contributing to evaporation losses. Driving component 100 can be positioned externally relative to container 30, and is movable independently from container 30. In advantageous embodiments as illustrated in FIG. 1, driving component 100 comprises an external magnetic coupling component. The external magnetic coupling component includes one or more external magnets 102 as needed to establish a magnetic field pattern suitable for maintaining an attraction between external magnet 102 and internal magnet 92 of drivable component 90 across the thickness of the wall of container 30. Driving component 100 can further comprise a support member 104 such as a housing, plate, or the like for supporting external magnet(s) 102. As can be appreciated by persons skilled in the art, the structure of driving component 100 and its proximity to container 30 is such that external magnet 102 is magnetically coupled with internal magnet 92 of drivable component 90 to a degree that enables drivable component 90 to move in response to movement of driving component 100, while preventing drivable component 90 from being decoupled and allowing movable component 60 to drop to the bottom 32 of container 30.

Figure 3:
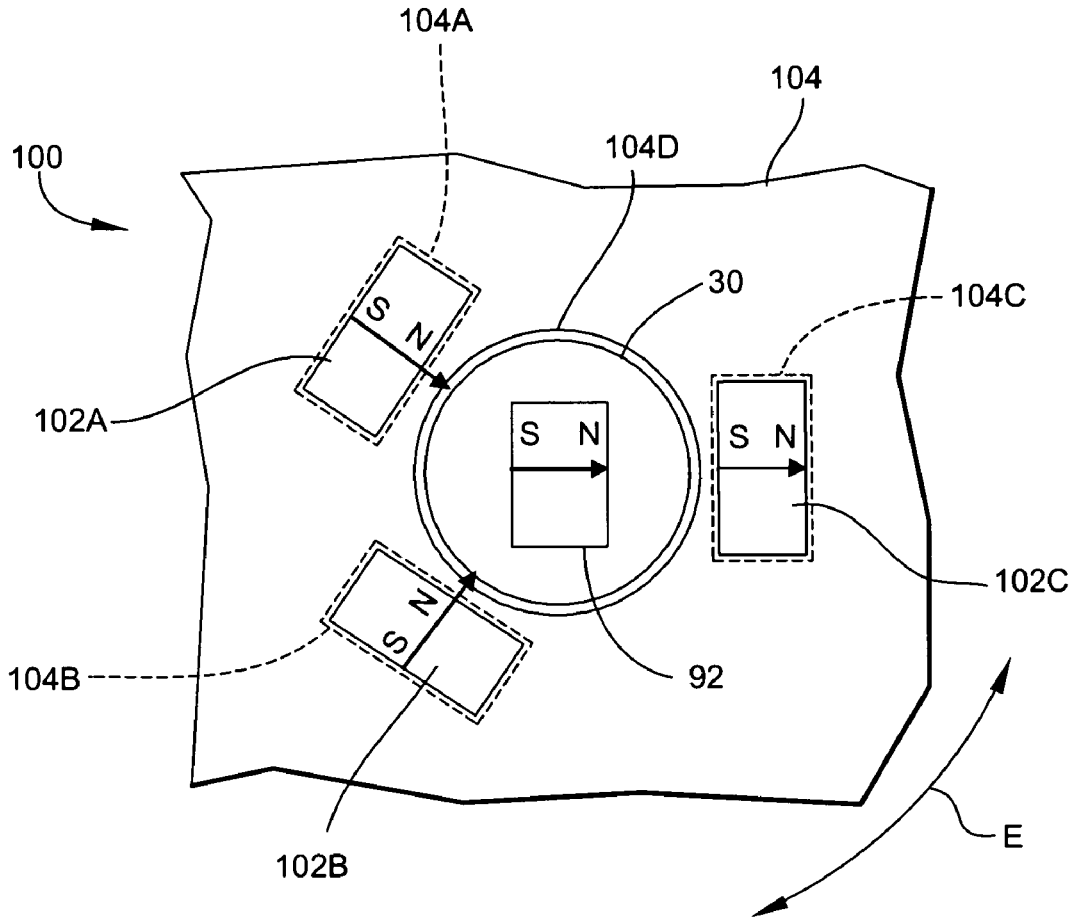
FIG. 3 is a top plan view of the interior of a test vessel unit and an external driving component according to an embodiment of the present disclosure.

In advantageous embodiments as shown in FIG. 3, driving component 100 can comprise a plurality of external magnets 102A, 102B, and 102C circumferentially arranged relative to internal magnet 92. For instance, FIG. 3 illustrates three external magnets 102A, 102B, and 102C circumferentially spaced apart at 120 degree intervals, although more or less external magnets 102A, 102B, and 102C at greater or lesser intervals could be employed. External magnets 102A, 102B, and 102C are disposed in respective recesses or pockets 104A, 104B, and 104C formed in support member 104. The arrangement provides a balance of magnetic forces during agitation that can enhance the stability of the coupling relation between internal magnet 92 and external magnets 102A, 102B, and 102C and reduce any skipping, jittering or other undesired motion of movable component 60 (FIGS. 1 and 2) due to friction or field imperfections. In this embodiment, container 30 extends coaxially through an aperture 104D defined by support member 104, facilitating the ability of external magnet or magnets 102A, 102B, and 102C to maintain a controllable magnetic coupling relation with internal magnet 92. In other embodiments, driving component 100 can be situated proximate to container 30 without completely circumscribing it.

FIG. 3 illustrates a single test site where one container 30 and a set of one or more external magnets 102A, 102B, and 102C are located. In other embodiments, more than one test vessel 20 (FIGS. 1 and 2) can be operated simultaneously. Hence, a single driving component 100 can be constructed to accommodate several test sites at which respective containers 30 and one or more external magnets or sets of magnets 102A, 102B, and 102C are located. Alternatively, a plurality of driving components 100 can be provided for a corresponding number of test vessel sites. In the case where a plurality of test sites are provided, FIG. 3 can be considered as illustrating a section of driving component 100 at which one test site is defined or one of several driving components 100.

As indicated by arrow A in FIG. 1, driving component 100 in some embodiments is reciprocatable relative to container 30. In the illustrated embodiment, driving component 100 is axially reciprocatable along a length of container 30 although other paths of reciprocation could be rendered. Driving component 100 can be reciprocated by any suitable means, such as a motor and linkage or transmission assembly operatively communicating with driving component 100. Due to the magnetic coupling between external magnet 102 of driving component 100 and internal magnet 92 of drivable component 90, the reciprocation of driving component 100 results in reciprocation of movable component 60 as indicated by arrow B, including drivable component 90 and sample carrier support member 64. Consequently, sample carrier 14 and the sample material it carries are reciprocated through media 16 in container 30.

In the embodiments just described, reciprocation of sample carrier 14 is attained by moving driving component 100 while container 30 remains stationary. An alternative embodiment, however, can be readily appreciated from FIG. 1 in which external magnet 102 remains stationary and container 30 is reciprocated. In this alternative embodiment, a suitable driving source is mechanically coupled to container 30 by any known means to cause reciprocative displacement of container 30 through space. Due to the magnetic coupling between external magnet 102 and internal magnet 92, the position of sample carrier support member 64 and sample carrier 14 relative to the container 30 remains fixed or substantially fixed while container 30 is being reciprocated. This alternative arrangement could be provided to yield an analogous hydrodynamic effect within container 30, in which the position of sample carrier 14 changes relative to the volume of media 16 residing in container 30.

In advantageous embodiments, as illustrated in FIG. 1, sample testing apparatus 10 further comprises a pick-up component 110 disposed in container 30 for selective coupling or engagement with movable component 60. Pick-up component 110 facilitates removal of movable component 60 and any sample carrier 14 supported thereby from container 30, and enables sample carrier 14 to be handled or transported without contact to reduce the risk of contamination or damage. In advantageous embodiments, pick-up component 110 is attached to or, equivalently, integrated with closure member 40. By this configuration, after movable component 60 has been coupled with or attached to pick-up component 110, movable component 60 and sample carrier 14 can be removed from container 30 by removing closure member 40. For embodiments in which drivable component 90 comprises an internal magnetic coupling, pick-up component 110 can comprise a pick-up magnet 112. As illustrated in FIG. 1, pick-up magnet 112 can be enclosed within central portion 48 of closure member 40. Pick-up magnet 112 can be configured (e.g., size, material, or the like) to induce a stronger magnetic coupling relation with drivable component 90 as compared with driving component 100. In this manner, when it is desired to remove movable component 60 and sample carrier 14 from container 30, driving component 100 is actuated to translate movable component 60 toward pick-up component 110—i.e., in the direction of opening 34 (FIG. 2) of container 30—by a greater stroke than normally occurs during the afore-described reciprocative cycle. The distance between internal magnet 92 of movable component 60 and pick-up magnet 112 reduces to a value at which the magnetic attraction between internal magnet 92 and pick-up magnet 112 is stronger than that between internal magnet 92 and external magnet 102 of driving component 100, at which time closure member 40 can be manipulated to remove movable component 60 from container 30.

As schematically indicated in FIG. 1, driving component 100 can be powered by a drive system 120 of any type envisioned by persons skilled in the art. Generally, drive system 120 can comprise any system or assembly capable of producing reciprocative and/or rotative (including stirring) motion that can be transferred to drivable component 90 via the non-contact coupling provided by driving component 100. Thus, drive system 120 can include a motor and a transmission or linkage (not shown) communicating with driving component 100. Depending on the design of drive system 120, driving component 100 may be considered as being a part of the transmission or linkage. Reciprocative and/or rotative motion can be produced by a reversible motor, i.e., one whose rotational direction can be repeatedly changed, or by a transmission or linkage designed to convert motor-generated rotation into reciprocation and/or rotation. For instance, drive system 120 can comprise a DC motor coupled to a crank mechanism that produces linear reciprocating motion. Other non-limiting examples of transmission or linkage components through which driving component 100 can communicate with a motor include rack and pinion arrangements, belt or chain and pulley arrangements, carriages or stages guided by tracks, or the like. As a general matter, a wide variety of drive systems 120 are known to persons skilled in fields such as lab automation and robotics, and accordingly drive system 120 need not be described further in the present disclosure.

In operation, test vessel 20 is prepared by assembling movable component 60 with sample carrier 14 including the sample to be tested, as previously described with reference to FIG. 2. Container 30 is filled to a desired level with a selected medium 16. Movable component 60 is then inserted into container 30 and closure member 40 is used to seal container 30. If pick-up component 110 is provided and integrated with closure member 40, closure member 40 can be handled to insert movable component 60 into container 30. Before, during or after assembly, test vessel 20 is mounted at a suitable test site where driving component 100 can be actuated. Actuation of driving component 100 causes movement of movable component 60, and thus sample carrier 14 and the sample material carried thereby, by way of reciprocation or rotation through medium 16 residing in container 30. In processes where sealing is desired, container 30 remains sealed during agitation to prevent the loss of any contents of container 30.

It can be appreciated that the utility and advantages provided by effecting movement or agitation in container 30 by means of non-contact actuation can extend to implementations in which the use of a fully sealing closure member 40 is not desired or required. It will therefore be understood that the present disclosure encompasses embodiments and methods in which non-contact actuation is enabled without sealing container 30 in the manner described herein.

Figure 4:
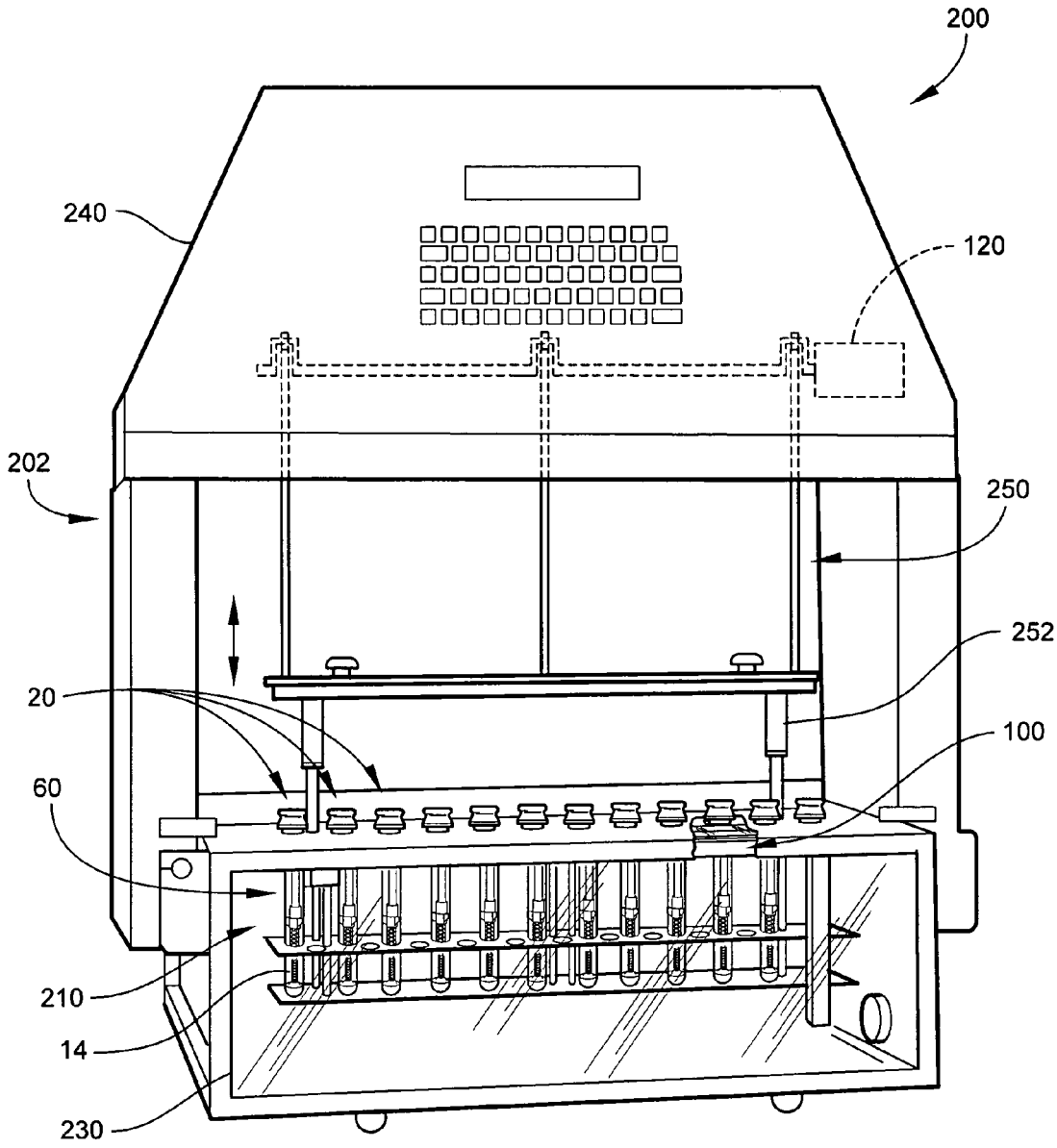
FIG. 4 is a front view of a sample test apparatus adapted for operating one or more test vessel units according to another embodiment.

Referring now to FIG. 4, a sample testing apparatus, generally designated 200, is illustrated according to another embodiment in which several testing procedures can be respectively performed in a plurality of test vessel units 20 operating simultaneously. Sample testing apparatus 200 can include a frame, generally designated 202, for supporting various components. In some embodiments, sample testing apparatus 200 includes a vessel support assembly, generally designated 210. Vessel support assembly 210 can comprise any structure suitable for defining an array of test sites at which one or more test vessel units 20 can be located—preferably in a consistent, repeatable manner—and which is compatible with the use of a drive system 120 and one or more driving components 100 as described above. For example, vessel support assembly 210 can comprise one or more vessel plates. In the exemplary embodiment best illustrated in FIG. 5, vessel support assembly 210 comprises a top vessel plate 222 having apertures 222A through which test vessel units 20 can be extended. Vessel support assembly 210 also comprises a medial vessel plate 224 disposed below top vessel plate 222, which also has apertures 224A for positioning test vessel units 20, as well as a base plate 226 for supporting bottom 32 of each test vessel unit 20 mounted in vessel support assembly 210.

As shown in FIG. 4, frame 202 of sample testing apparatus 200 can support a temperature regulating section 230 at which vessel support assembly 210 and test vessel units 20 are located. Temperature regulating section 230 can comprise any structure suitable for regulating the temperature of the media contained in test vessel units 20 if desired, such as when proceeding in accordance with certain published USP guidelines. For example, temperature regulating section 230 can comprise a temperature-controlled water bath in which test vessel units 20 are immersed. Alternatively, means can be provided for heating individual test vessel units 20 directly instead of providing a bath. Techniques for regulating temperature during dissolution testing are generally known to persons skilled in the art.

As also illustrated in FIG. 4, sample testing apparatus 200 can comprise a control head assembly 240 supported by frame 202 above vessel support assembly 210. In general, control head assembly 240 can provide any number of functions that enable automation or control of one or more aspects of testing procedures, including user input, readout, and interfacing with other modules of a larger analytical system. Control head assembly 240 can also be used to contain a drive system 120 such as previously generally described.

Figure 5:
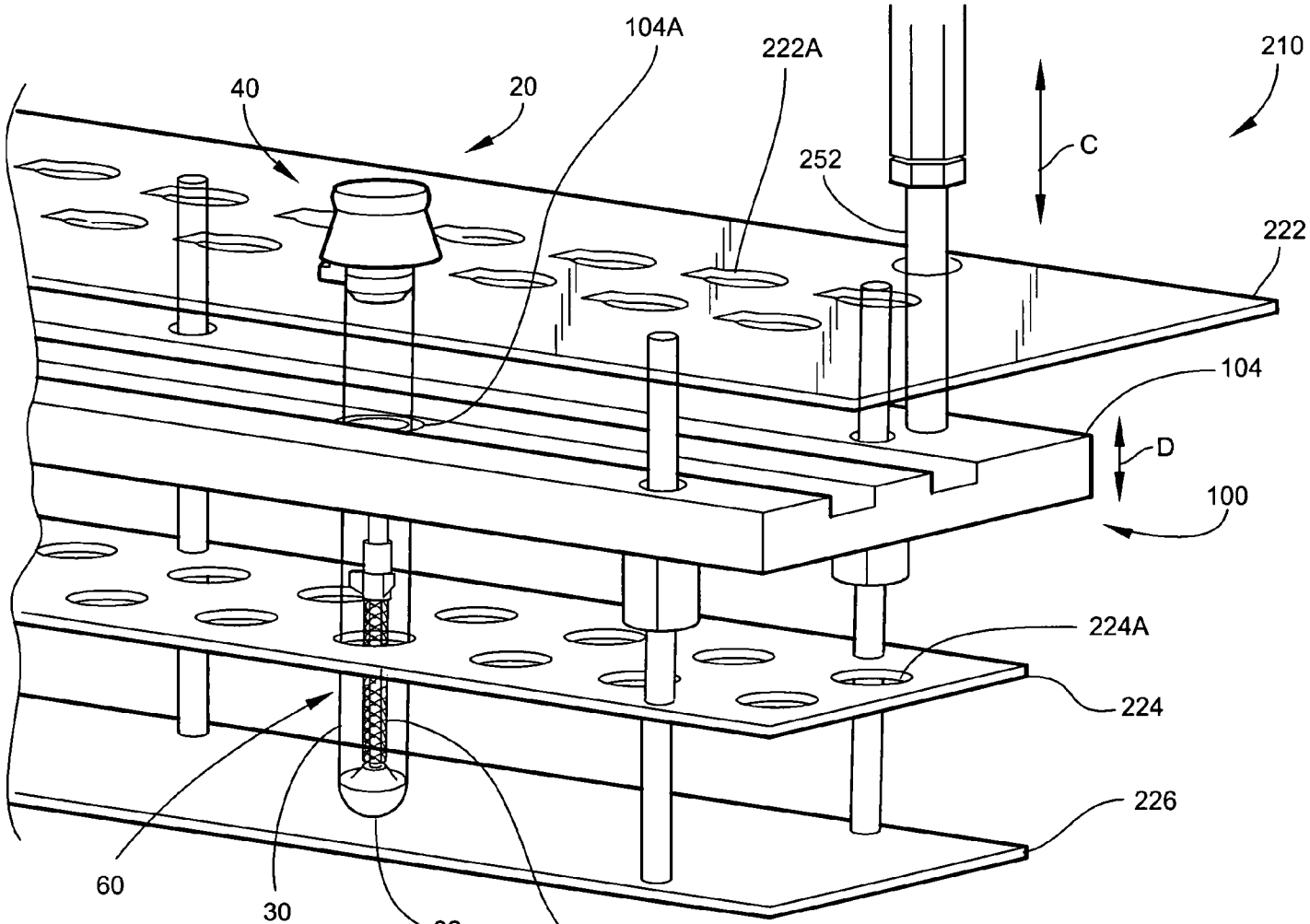
FIG. 5 is a perspective view of a portion of the sample test apparatus illustrated in FIG. 4 at which one or more test vessel units can be located.

In advantageous embodiments, a single drive system 120 enables the agitation of samples in all test vessel units 20 operating in sample testing apparatus 200. As shown in FIG. 4, a linkage assembly, generally designated 250, serves as the interface between drive system 120 and driving component 100. Generally, linkage assembly 250 can include any suitable arrangement of one or more rods, pistons, or other linkage members 252 as needed to realize this interface. As illustrated in FIG. 5, one or more linkage members 252 may be connected to support member 104 of driving component 100. In reciprocating embodiments, reciprocation of one or more linkage members 252 as indicated by arrow C results in reciprocation of external driving component 100 as indicated by arrow D.

As also shown in FIGS. 4 and 5, driving component 100 can comprise a single support member 104 such as an agitation platform. Support member 104 can be configured for a plurality of test sites as previously described in conjunction with FIG. 3 to provide one or more external magnets (e.g., external magnets 102A, 102B, and 102C in FIG. 3) for each corresponding test vessel unit 20. As shown in FIG. 5, the apertures 104A of support member 104 are coaxially aligned with those of vessel plates 222 and 224 to enable a single support member 104 to reciprocate generally in parallel with the axes of test vessel units 20. In other embodiments, test vessel units 20 can be associated with separate respective driving components 100, with each driving component 100 including an external magnet 102 or set of external magnets 102A, 102B, and 102C.

In operation, one or more test vessel units 20 are prepared and assembled as previously described, and test vessel units 20 are loaded into vessel support assembly 210. Drive system 120 is operated to reciprocate driving component(s) 100. Each external magnet 102 (FIG. 1) or set of external magnets 102A, 102B, and 102C (FIG. 3) reciprocates with support member 104 of driving component 100. Accordingly, for every test vessel unit 20 being operated that contains a movable component 60 (FIGS. 1 and 2) as described above, the reciprocation of driving component 100 drives movable components 60 to likewise reciprocate within test vessel units 20 (as indicated by arrow B in FIG. 1), thereby simultaneously agitating all corresponding sample carriers 14. In preparation for removing sample carriers 14 from their respective containers 30, drive system 120 can be operated or programmed to actuate driving component 100 upwardly to bring each movable component 60 into coupling relation with respective pick-up components 110 (FIG. 1), as described above according to embodiments of the present disclosure.

In an alternative embodiment in which external magnets 102 (FIG. 1) are fixed in position while test vessel units 20 themselves are reciprocated, one of the plates of vessel support assembly 210 could be provided with means for engaging test vessel units 20 and coupled with linkage assembly 250 in an analogous manner.

FIG. 6 illustrates another embodiment, generally designated 300, in which sample testing can be optimized for a wide range of sizes of sample carriers 14. A test vessel, generally designated 320, comprises a container 330 having a necked-down or stepped-down profile. Container 330 includes at least two distinct first and second container sections 330A and 330B. First and second container sections 330A and 330B have different axial lengths and/or inside diameters, and thus have different internal volumes. Typically, the media used in container 330 will occupy only second container section 330B. Sample carrier 14 is mounted to sample carrier support member 64 of movable component 60 such that sample carrier 14 is agitated only through second container section 330B where the medium is located. Second container section 330B is sized to provide the optimal media volume for the particular sample carrier 14 being tested. In the context of dissolution testing, the optimal media volume is that which yields the highest resolution in the course of acquiring the optical data utilized to generate a dissolution curve. Typically, the optimal media volume is the smallest volume feasible for testing a sample carrier 14 of a given size.

FIG. 6 also illustrates another test vessel, generally designated 420, comprising a container 430 that likewise includes first and second container sections 430A and 430B of different volumes. By comparison, second container section 430B of container 430 is larger than second container section 330B of container 330 in order to accommodate, or optimize test conditions for, a larger-sized sample carrier 14. However, in order to standardize the sizes and features of as many other components as possible (e.g., closure member 40, drivable component 90, driving component 100, vessel support assembly 210, and the like), the dimensions of first container section 430A of container 430 can be made the same as those of first container section 330A of container 330. Thus, both test vessel 420 and test vessel 320 can operate in the same apparatus with minimal or no modifications or adjustments.

As described previously, the movement of movable component 60 can constitute a linear reciprocation along the longitudinal axis of container 30 and/or rotation about the longitudinal axis, depending on what mode of agitation is appropriate or desired for the test being conducted. Referring to FIG. 3, in some embodiments, rotation of movable component 60 can be magnetically actuated by rotating external magnet(s) 102A, 102B, 102C to cause internal magnet 92 to rotate by means of the resulting changes in orientation of the magnetic field. As indicated by arrow E in FIG. 3, the rotation can be in one direction through repeating full (360-degree) cycles or can be in alternating directions (e.g., clockwise/counterclockwise) through partial cycles.

The rotation of external magnet(s) 102A, 102B, 102C can be actuated and controlled by any suitable driving means now known or later developed. Without intending to limit the scope of the subject matter in any way, one example of a driving means includes an annular rotatable member (not shown) coaxially disposed about container 30 (FIG. 3) and supported by support member 104 of driving component 100. External magnet(s) 102A, 102B, 102C are mounted to and rotate with the rotatable member. The rotatable member can include pulley- or cog-like features to be driven by a belt or chain. Alternatively, the rotatable member can include teeth for meshing with a driving gear coupled with driving system 120 (FIGS. 1 and 4).

Figure 7:
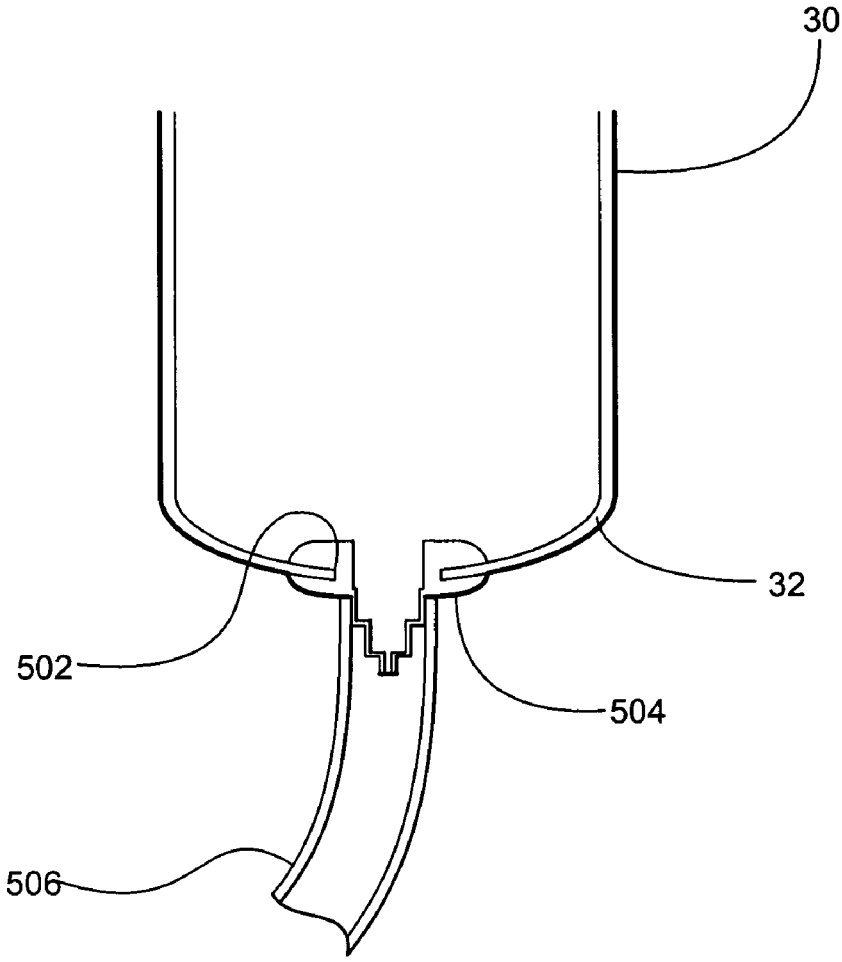
FIG. 7 is a cross-sectional elevation view of a bottom portion of a test vessel unit according to another embodiment.

Referring now to FIG. 7, another embodiment is disclosed in which container 30 (or container 330 or 430 shown in FIG. 6) has an opening 502 at its bottom 32. Bottom opening 502 can serve a number of functions, particularly as an inlet and/or outlet for liquid or instruments before, during, and after dissolution of sample material. For example, bottom opening 502 can be employed to fill container 30 with media 16 (FIG. 1), take samples from container 30, provide access for a temperature probe, admit rinsing fluid into container 30 for washing, admit buffers or reagents into container 30, refill or replenish media 16, provide access for an optical probe or light pipe to acquire optical-based data, and so on. For these and any other such purposes, bottom opening 502 can be selectively opened and closed by fitting a closure member 504 into sealing contact with the edge-area surfaces defining bottom opening 502. Alternatively, closure member 504 can be formed as a fitting with a bore adapted to receive a lab-quality conduit 506 suitable for handling fluid. Conduit 506 may be removable such as by fashioning closure member 504 with a Luer-type fitting, or may be attached to closure member 504 by a suitable bonding material such as epoxy resin. As appreciated by persons skilled in the art, conduit 506 can be part of a closed fluidic system and thus does not detrimentally affect the ability of closure member 40 to completely seal container 30 during desired time periods.

The functions of or activities enabled by bottom opening 502 are traditionally carried out from the top of container 30. Indeed, the afore-described closure member 40 (FIG. 1) that is fitted to top opening 34 in some embodiments could be provided with one or more conduits, probes and the like, and such an embodiment is encompassed within the scope of the present disclosure. However, the use of bottom opening 502 in the present embodiment allows closure member 40, when provided, to be optimized for its primary purpose of preventing evaporation loss.

In any of the embodiments described herein in which magnets are employed to enable movement by non-contacting actuation, it will be understood that the magnets can include permanent magnets, electromagnets, or both. Accordingly, terms such as "magnet", "magnetic" and "magnetic coupling" as used throughout this disclosure encompass the use of a permanent magnet and/or an electromagnet. Stated alternatively, the term "magnet" as used herein can be a material that exhibits magnetization due to its possessing a permanent magnetic dipole or in response to an external field or application of electrical current. For instance, external magnets 102A, 102B, 102C (FIG. 3) and/or pick-up magnet 112 (FIG. 1) can be provided as electromagnets to enable selective magnetic coupling with internal magnet 92 (FIG. 1). In embodiments in which an electromagnet is provided, it will be appreciated by persons skilled in the art that the electromagnet can be placed in communication with a suitable electrical current or voltage source through electrical leads, and may entail the use of coils, solenoids, or the like to produce a magnetic field of sufficient strength to control, for example, movable component 60.

The use of electromagnets can offer functional advantages. For instance, if provided as an electromagnet, pick-up magnet 112 can be energized only when it is desired to use closure member 40 to install or remove movable component 60 and de-energized at other times. After movable component 60 has been installed in container 30, movable component 60 can be decoupled from pick-up magnet 112 by de-energizing pick-up magnet 112 such as by cutting off electrical current to pick-up magnet 112. This allows movable component 60 to drop farther into container 30 to a suitable operating position at which movable component 60 can be magnetically coupled with external magnet(s) 102A, 102B, 102C, either due to an electrical current applied to external magnet(s) 102A, 102B, 102C or to the presence of a permanent magnetic dipole in the material of external magnet(s) 102A, 102B, 102C. In addition, the magnetic coupling between external magnet(s) 102A, 102B, 102C and movable component 60 can be selectively established in the case where external magnet(s) 102A, 102B, 102C are electromagnets.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An apparatus for actuating movement of an implantable medical device during in vitro testing, the apparatus comprising:

a movable component including means for holding the implantable medical device in a container during movement of the movable component in the container, wherein the implantable medical device holding means includes a body, a first support member and a second support member, the first and second support members attached to the body and axially spaced from each other for securing the implantable medical device between the first and second support members, and wherein at least one of the first and second support members is axially adjustable along the body for varying the space between the first and second support members; and a drivable component attached to the implantable medical device holding means, the drivable component including means for actuating the drivable component and the implantable medical device holding means to move together in the container, the actuating means responsive to non-contacting coupling with a driving source disposed entirely outside the container.

2. The apparatus of claim 1, wherein the actuating means includes a magnet for magnetic coupling with the driving source.

3. The apparatus of claim 1, wherein the first and second support members include respective first and second surfaces for contacting opposing ends of the implantable medical device, and the first and second surfaces are tapered for providing full contact with implantable medical device ends of differing dimensions.

4. The apparatus of claim 1, further including the driving source coupled to the actuating means.

5. The apparatus of claim 4, wherein the driving source includes an external magnet and the actuating means includes an internal magnet for magnetic coupling with the external magnet.

6. The apparatus of claim 5, wherein the driving source includes a movable platform supporting the external magnet.

7. The apparatus of claim 1, further including the container, wherein the container includes a first container section having a first dimension defining a first section volume in which the drivable component moves, and a second container section having a second dimension different from the first dimension and defining a second section volume in which the implantable medical device holding means moves, the second section volume being different from the first section volume.

8. The apparatus of claim 1, further including the container, and a closure member sealing the container for substantially preventing loss of contents from the container during movement of the drivable component and the implantable medical device holding means, the closure member being physically separate from the drivable component and the implantable medical device holding means.

9. The apparatus of claim 8, wherein the closure member includes a body covering an opening of the container, and a pick-up magnet attached to the body for magnetically coupling with the drivable component to facilitate handling of the implantable medical device supporting means without manually contacting the implantable medical device holding means.

10. An apparatus for actuating movement of a dosage form during in vitro testing, the apparatus comprising:

a movable component including means for holding the dosage form in a container during movement of the movable component in the container, wherein the dosage form holding means includes a body, a first support member and a second support member, the first and second support members attached to the body and axially spaced from each other for securing the dosage form between the first and second support members, and wherein at least one of the first and second support members is axially adjustable along the body for varying the space between the first and second support members; and a drivable component attached to the dosage form holding means, the drivable component including means for actuating the drivable component and the dosage form holding means to move together in the container, the actuating means responsive to non-contacting coupling with a driving source disposed entirely outside the container.

11. The apparatus of claim 10, wherein the actuating means includes a magnet for magnetic coupling with the driving source.

12. The apparatus of claim 10, further including the driving source coupled to the actuating means.

13. The apparatus of claim 12, wherein the driving source includes an external magnet and the actuating means includes an internal magnet for magnetic coupling with the external magnet.

14. The apparatus of claim 13, wherein the driving source includes a movable platform supporting the external magnet.

15. The apparatus of claim 10, further including the container, wherein the container includes a first container section having a first dimension defining a first section volume in which the drivable component moves, and a second container section having a second dimension different from the first dimension and defining a second section volume in which the dosage form holding means moves, the second section volume being different from the first section volume.

16. The apparatus of claim 10, further including the container, and a closure member sealing the container for substantially preventing loss of contents from the container during movement of the drivable component and the dosage form holding means, the closure member being physically separate from the drivable component and the dosage form holding means.

17. The apparatus of claim 16, wherein the closure member includes a body covering an opening of the container, and a pick-up magnet attached to the body for magnetically coupling with the drivable component to facilitate handling of the dosage form holding means without manually contacting the dosage form holding means.

* * * * *